US007152424B2

(12) United States Patent
Shoukyuu et al.

(10) Patent No.: US 7,152,424 B2
(45) Date of Patent: Dec. 26, 2006

(54) ICE TRAY AND ICE MAKING MACHINE, REFRIGERATOR BOTH USING THE ICE TRAY

(75) Inventors: Masatoshi Shoukyuu, Kusatsu (JP); Akinori Tsujimoto, Mie (JP); Ichiro Onishi, Shiga (JP); Tadashi Adachi, Kusatsu (JP); Hiroshi Tatsui, Kusatsu (JP); Mitoko Ishita, Inazawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 105 days.

(21) Appl. No.: 10/971,992

(22) Filed: Oct. 22, 2004

(65) Prior Publication Data

US 2005/0126202 A1 Jun. 16, 2005

(30) Foreign Application Priority Data

Oct. 23, 2003 (JP) ..... 2003-363093
Dec. 19, 2003 (JP) ..... 2003-422526
Sep. 7, 2004 (JP) ..... 2004-259244

(51) Int. Cl.
*F25C 5/08* (2006.01)

(52) U.S. Cl. ..... 62/351; 62/353; 249/78

(58) Field of Classification Search ..... 62/3.63, 62/351; 219/552–553; 249/78, 111, 119
See application file for complete search history.

(56) References Cited

U.S. PATENT DOCUMENTS 2,717,501 A * 9/1955 Andersson ..... 62/137
2,717,503 A * 9/1955 Woehler ..... 62/138
2,799,144 A * 7/1957 Barton ..... 62/137
2,970,453 A * 2/1961 Harle et al. ..... 62/135
3,163,017 A * 12/1964 Baker et al. ..... 62/137
3,828,568 A * 8/1974 Frazier ..... 62/186
4,649,717 A 3/1987 Tate, Jr. et al.
4,833,894 A * 5/1989 Chesnut ..... 62/135
6,427,456 B1 8/2002 Niwa et al.

FOREIGN PATENT DOCUMENTS

JP 62-223582 A 10/1987
JP H6-6966 U 1/1994
JP 07-208841 A 8/1995
JP 09-079717 A 3/1997
JP 2000-161824 A 6/2000
JP 2001-272146 A 10/2001

OTHER PUBLICATIONS

International Search Report for PCT/JP2004/015856, dated Feb. 8, 2005.

* cited by examiner

*Primary Examiner*—William E. Tapolcai
(74) *Attorney, Agent, or Firm*—RatnerPrestia

(57) ABSTRACT

An ice tray includes a tray section and a heater. The tray section has a first face and a second face opposite to the first face. The first face temporarily retains water and the water is cooled to make ice. The heater is unitarily molded with the tray section at the second face, and warms the tray section for the ice to come off the tray section.

18 Claims, 9 Drawing Sheets

ICE TRAY AND ICE MAKING MACHINE, REFRIGERATOR BOTH USING THE ICE TRAY

BACKGROUND OF THE INVENTION

1. Field of the Invention

The present invention relates to an ice tray placed, for example, in a freezing compartment of an refrigerator and making ice by cooling the water poured therein, it also relates to an ice making machine and a refrigerator both using the same ice tray.

2. Background Art

A conventional ice tray placed in a freezing compartment of a refrigerator is disclosed, e.g. Japanese Patent Unexamined Publication No. 2001-272146, and the entire ice tray is made from aluminum. This conventional ice tray is described hereinafter with reference to FIGS. 12 and 13. FIG. 12 shows a perspective view of the conventional ice tray, and FIG. 13 shows a sectional view taken along line 13—13 shown in FIG. 12.

Ice tray 1 (hereinafter referred to simply as "tray") is made from aluminum alloy excellent in heat conductivity. Tray 1 includes plural cells 2 which temporarily retain water. Groove 3 rests between cells 2 adjacent to each other and communicates with those cells 2. As shown in FIG. 13, heaters 4 are rigidly mounted to underside of tray 1 solidly with screws or by claming.

An operation of tray 1 discussed above is described hereinafter. When water is poured into tray 1, the water runs via grooves 3 over the entire tray 1 and every cell 2 is filled with the water. On cell 2 can contain water of approx. 15 ml, so that tray 1 formed of 7 cells 2 can contain water of approx. 105 ml.

The water poured in tray 1 dissipates heat due to heat conduction through the water surface, the walls of tray 1 and heat radiant, and lowers its temperature gradually, then it finally freezes into ice. Supply of power to heater 4 melts an ice face touching tray 1, then the ice in tray 1 can be evacuated by discharging claws (not shown).

However, in the foregoing conventional structure, since heater 4 is rigidly mounted to tray 1 solidly with screws or by clamping, application of heat disperses depending on a location of cells 2. Thus cell 2 not heated enough cannot evacuate ice smoothly.

SUMMARY OF THE INVENTION

An ice tray of the present invention includes a tray section and a heater. The tray section has a first face and a second face opposite to the first face. The first face temporarily retains water and the water is cooled to make ice. The heater is formed on a side of the second face by unitary molding together with the tray section, and warms the tray section for the ice to come off the tray section. The unitary molding of the heater with the tray section stabilizes the solid contact between the tray section and the heater, so that respective cells are uniformly warmed. As a result, pieces of ice can be evacuated smoothly from the cells.

DETAILED DESCRIPTION OF THE INVENTION

Figure 1:
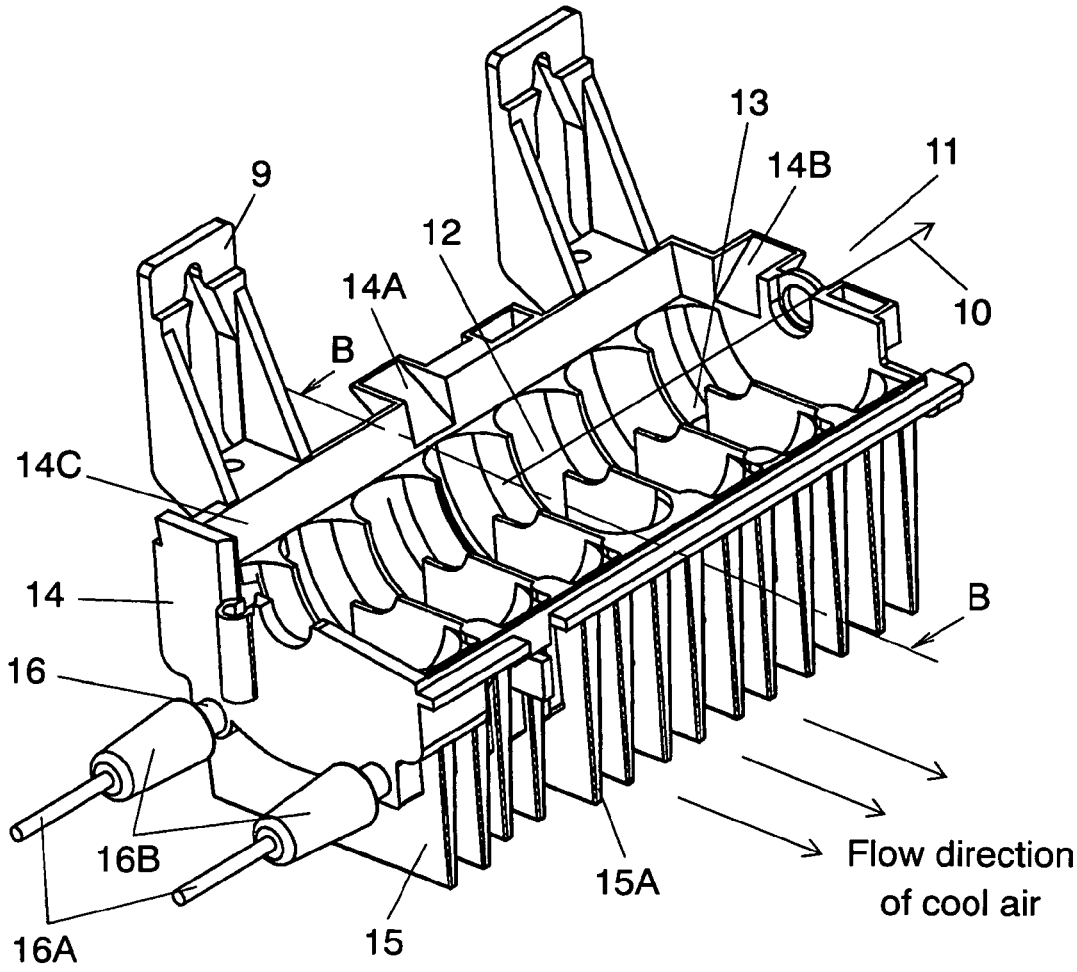
FIG. 1 shows a perspective view of an ice tray in accordance with an exemplary embodiment of the present invention.
Figure 2:
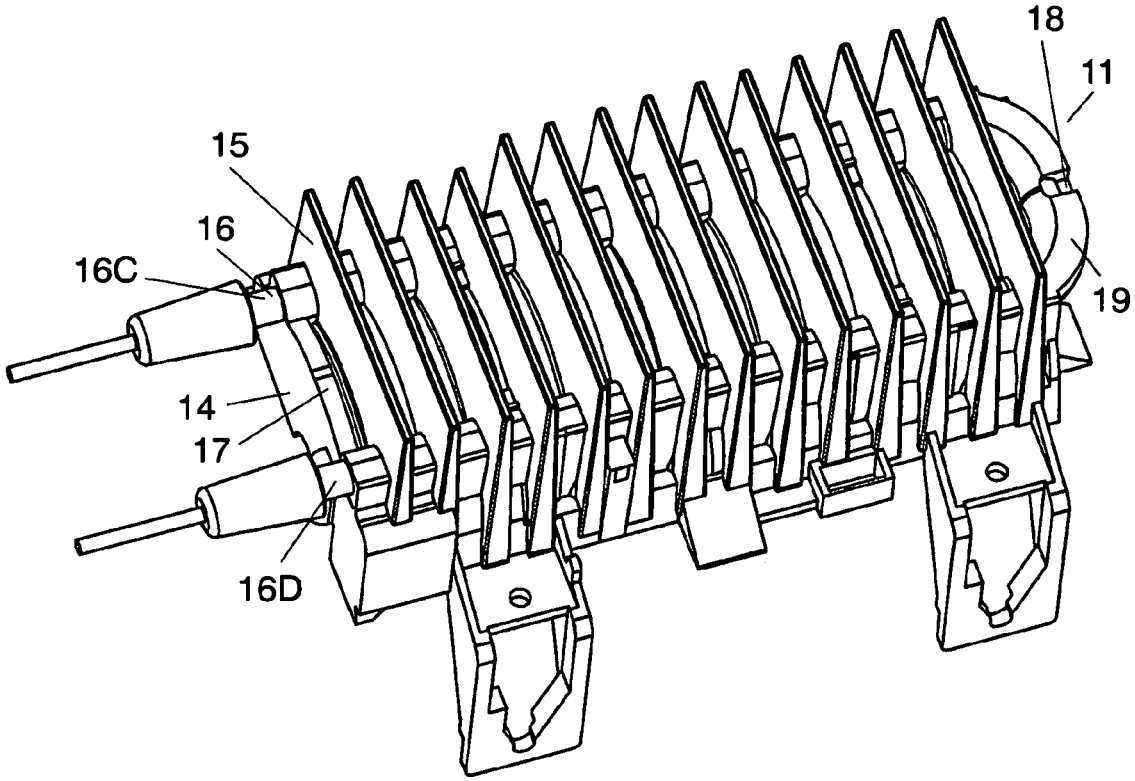
FIG. 2 shows a perspective view from a bottom side of the ice tray shown in FIG. 1.
Figure 3:
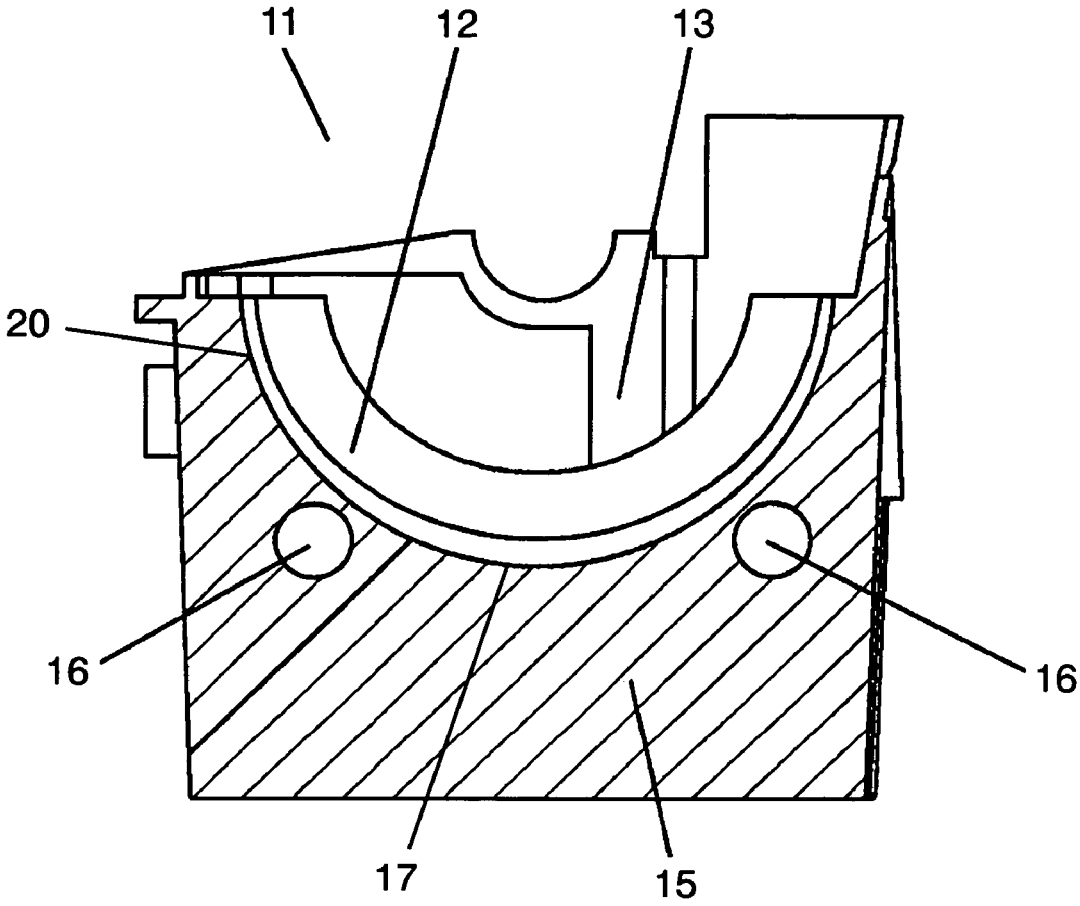
FIG. 3 shows a sectional view of the ice tray taken along line 3—3 shown in FIG. 1.

FIG. 1 shows a perspective view of an ice tray in accordance with an exemplary embodiment of the present invention. FIG. 2 shows a perspective view from a bottom side of the ice tray. FIG. 3 shows a sectional view of the ice tray taken along line 3—3.

Ice tray (hereinafter referred to simply as "tray") 11 has tray section 14 and water inlets 14A and 14B through which water is poured from water-supply valve (not shown) to tray section 14. Tray section 14 includes a first face on which plural semicircular cells 12 are provided for retaining water temporarily, and groove 13 is disposed on a lateral wall of cells 12 adjacent to each other so that the water can run back and forth between adjacent cells 12. In other words, tray section 14 has major axis direction 10 and a minor axis direction substantially perpendicular to the major axis, and its top face shapes in approx. rectangle. The construction shown in FIGS. 1 and 2 includes seven cells aligned in line.

Tray section 14 is preferably made from metal excellent in heat conductivity for dissipating heat well, and more preferably made from aluminum alloy. The aluminum-based material features high heat conductivity and a smaller specific gravity, so that tray 11 can be lighter in weight. Instead of forming entire tray 11 of aluminum alloy, frame 14C and mounting arm 9, i.e. elements other than cells 12, can be made from plastic resin in order to further reduce the weight.

Heater 16 warming tray section 14 is unitarily molded with tray section 14 at underside 17 (a second face) of tray section 14. Plural fins 15 are preferably disposed on underside 17 or lateral sides 20 of tray section 14. Fin 15 shapes like a plate and is placed such that its largest face is substantially perpendicular to major axis direction 10 of tray section 14. Fins 15 are more preferably molded unitarily together with tray section 14.

Tray 11 having undergone the unitary molding is a product of aluminum die casting, and when aluminum is poured into dies, heater 16 is wrapped with the aluminum and solidified, thereby molding tray section 14 and heater 16 into one piece. Heater 16 preferably shapes like letter U and warms uniformly overall underside 17 of tray section 14.

Lead wires 16A are coupled to heating wires (not shown) disposed in heater 16, and a joint of lead wire 16A and the heating wire is covered by joint section 16B made from rubber for insulation as well as drip proof.

An operation and an effect of the ice tray discussed above are demonstrated hereinafter. Water is poured into given cell 12 from a water supply valve (not shown) via either one of water inlets 14A or 14B, then the water runs to adjacent cell 12 via groove 13, so that every cell 12 is filled with the water. In this embodiment, water of approx. 105 ml is supplied so that each cell 12 can receive the water of approx. 15 ml. The water poured into tray 11 dissipates heat from tray section 14 and the water surface, thereby lowering its temperature gradually. Tray section 14, in particular, can accelerate cooling the water due to the effect of fins 15, so that the water freezes into ice in a short time.

After the ice making, heater 16 is powered to warm tray section 14, so that the ice comes off tray section 14. Then discharging claw (not shown) evacuates the ice from tray 11. Since heater 16 is unitarily molded with tray section 14, adherence between heater 16 and tray section 14 is steady, so that the respective cells 12 are uniformly warmed. As a result, the ice can be evacuated smoothly. Thus unnecessary powering to heater 16 can be saved, and when heater 16 is warmed up to an appropriate temperature, a thermistor (not shown) can halt the powering, thereby shortening a powering time of heater 16 and reducing the power consumption.

Since heater 16 is unitarily molded with tray section 14, heater 16 is not exposed to the atmosphere of a freezing compartment etc., so that caution more than necessary about corrosion is not needed, which allows heater 16 to use inexpensive material such as iron pipe heater. The unitary molding also eliminates clamping or screwing for rigidly mounting heater 16 to tray section 14, so that the number of assembly steps can be reduced.

If tray section 14 is unitarily molded with fins 15, there is no contact-thermal-resistance between tray section 14 and fins 15. High heat conductivity can be thus achieved between those two elements, so that heat-exchange is further accelerated and the water freezes into ice in a shorter time.

Fins 15 protrude from underside 17 opposite to cells 12 retaining the water of tray section 14 and/or from lateral face 20 solid with underside 17. Heater 16 is unitarily molded with tray section 14 at underside 17. It is preferable for fins 15 to be placed at an area under heater 16. In other words, fins 15 are preferably placed on the opposite side to cells 12 with respect to heater 16. A conventional structure, where a heater is retrofitted to a ice tray, does not allow placing fins 15 under heater 16. On the other hand, in this embodiment, since heater 16 is unitarily molded with tray 11, fins 15 can be placed under heater 16. In other words, fins 15 can be effectively placed near heater 16 regardless of the location of heater 16. The surface area of fins 15 can be thus increased substantially, thereby accelerating the heat exchange. As a result, ice making can be completed in a shorter time.

Fins 15 are preferably placed perpendicular to major axis direction 10 of tray section 14, and more preferably they are placed at similar intervals. Plate-like fins 15 are preferably placed generally in parallel with a flow of cool air. Each of the features of the structure discussed above has the greater number of edges 15A of fins 15, where heat is transmitted most actively at edges 15A, than a case where the fins are placed generally in parallel with the major axis direction of tray section 14. Thus the heat-exchange with the cool air is accelerated, and the cool air flows smooth, so that difference in heat transmission depending on the location of cells 12 with respect to major axis direction 10 can be reduced, which decreases difference in ice making speed depending on positions of cells 12. The thermistor (not shown) for sensing the completion of ice making can be thus mounted to tray section 14 at any place, so that the construction of the ice tray can be designed with higher degree of freedom. Meanwhile, the largest-area face of fin 15 can be not strictly vertical to major axis direction 10, but a plane including the largest-area surface of fin 15 can only intersect with the major axis direction.

It is preferable to provide notch 18 to heater 16 at letter-U section 19 projected from tray section 14 for positioning heater 16 with ease when the unitary molding is carried out. This structure allows supporting heater 16 at three points, i.e. exposed sections 16C, 16D of heater 16 and notch 18, so that a position of heater 16 becomes stable when the unitary molding is carried out. As a result, heater 16 and tray section 14 can be molded unitarily with ease.

Notch 18 placed at approx. center of letter-U section 19 allows supporting heater 16 in well balance, so that the position of heater 16 becomes further stable.

Figure 4:
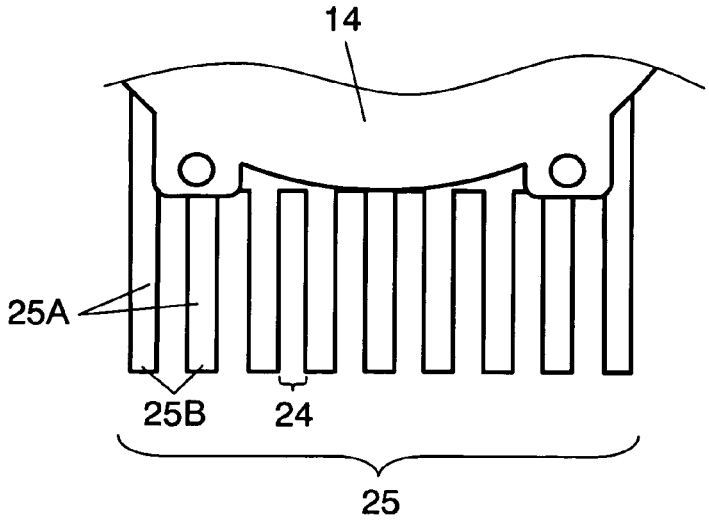
FIG. 4 shows an enlarged front view illustrating a shape of fins in accordance with the exemplary embodiment of the present invention.
Figure 5A:
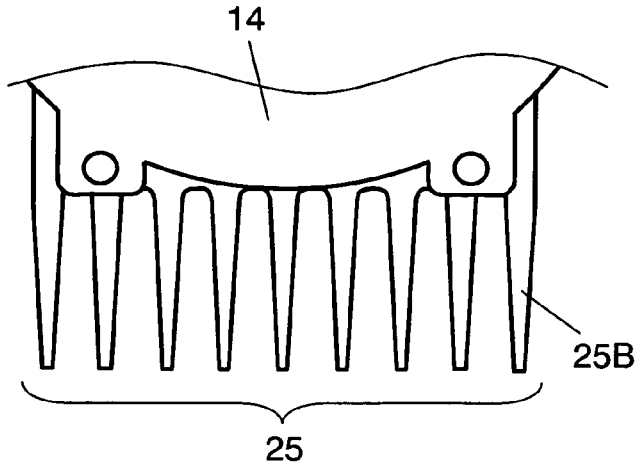
FIG. 5A shows an enlarged front view illustrating another shape of fins of an ice tray in accordance with the exemplary embodiment of the present invention.
Figure 5B:
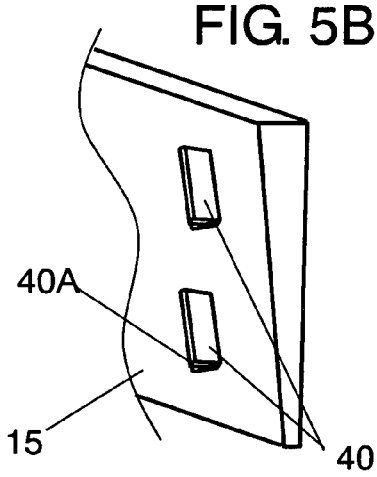
FIG. 5B shows an enlarged perspective view illustrating still another shape of fins of an ice tray in accordance with the exemplary embodiment of the present invention.

Next, another shape of the fin is demonstrated hereinafter. FIGS. 4 and 5A show enlarged front views of another shape of fins. FIG. 5B shows enlarged perspective views of still another shape of fins.

In FIG. 4, fin 25 is formed by dividing a plate-like fin into a number of sub-fins with slits 24, namely, fin 25 shapes like a comb having a number of projections 25B. This structure increases the number of edges 25A where heat is transmitted most actively, i.e. this structure accelerates the turbulent flow and increases the leading edge effect. As a result, the heat exchange between tray section 14 and cool air is accelerated, and the ice making is completed in a shorter time.

In FIG. 5A, each one of projections 25B of fin 25 tapers like a spire or a needle. This structure allows reducing a volume of fin 25 free from losing the heat-exchange performance, so that the material cost can be lowered.

As shown in FIG. 5B, each one of fins 15 preferably includes louver plates 40, which are formed by cutting and pulling parts of fin 15, and face the flow of cool air, and each one of the louver plate leaves opening 40A resulting from the cut and pull. The louver plates 40 accelerate turbulent flow and increase leading edge effect, so that the heat exchange is further accelerated. As a result, the ice making can be completed in a shorter time.

Figure 6:
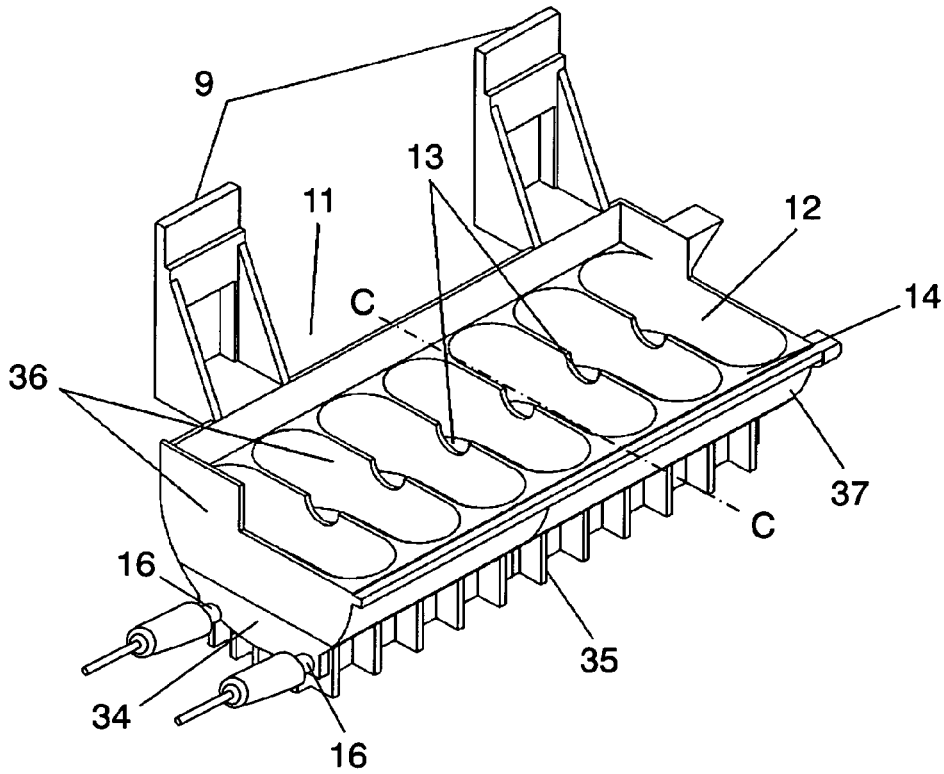
FIG. 6 shows a perspective view of another ice tray in accordance with the exemplary embodiment of the present invention.
Figure 7:
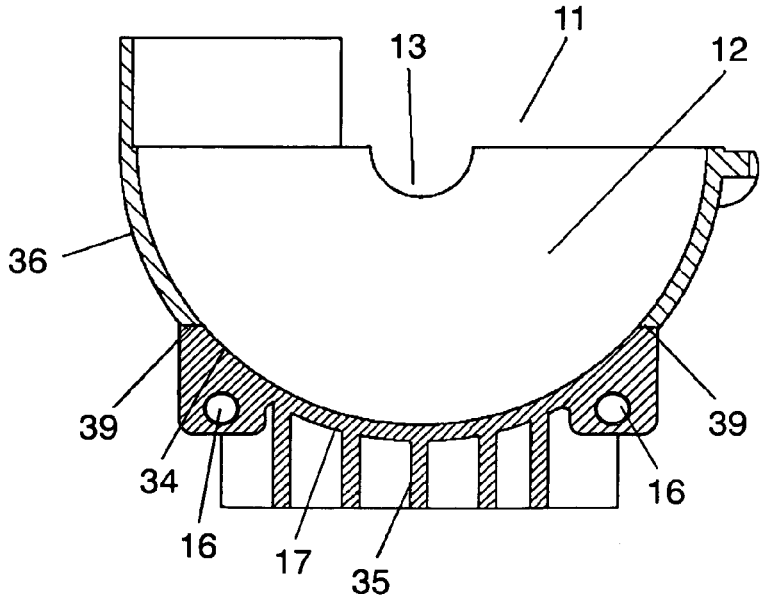
FIG. 7 shows a sectional view of the ice tray taken along line 7—7 shown in FIG. 6.

Next, another structure of tray section 14 is demonstrated. FIG. 6 shows a perspective view illustrating another ice tray in accordance with the exemplary embodiment of the present invention. FIG. 7 shows a sectional view of the ice tray taken along line 7—7 shown in FIG. 6.

In ice tray (hereinafter referred to simply as "tray") 11, the bottom of each cell 12, namely, underside 17 of tray section 14, is made from metallic plate 34 excellent in heat conduction in order to improve heat dissipation. Plate 34 is further preferably made from aluminum alloy because of excellency in heat conductivity and light in weight. Plate 34 is preferably equipped with fins 35.

Lateral wall 36, frame 37 and mounting arm 9, i.e. other areas than underside 17 of tray section 14, are made from resin because of smaller specific gravity. This partially resin-used structure allows reducing the weight by approx. 30% from the ice tray made entirely from aluminum alloy, so that ice tray 11 of light in weight is obtainable at a lower cost. Use of thermoplastic resin allows forming a complicated shape with ease. Other structures than what are discussed above remain unchanged from the structure shown in FIGS. 1 through 3.

Plate 34 and lateral wall 36 are preferably jointed at joint face 39 as close as on the order of nanometer. Such a close joint makes adhesion so strong that no gap through which water can enter is available.

Water is poured into given cell 12 of tray 11, then the water runs to adjacent cell 12 via groove 13, so that every cell 12 is filled with the water. The water poured into tray 11 dissipates heat from underside 17 (plate 34), lateral wall 36 and the water surface, thereby lowering its temperature gradually. Plate 34, in particular, can accelerate cooling the water due to the effect of fins 35, so that the water freezes into ice in a short time. As previously discussed, heater 16 warms tray section 14 after that, so that the ice comes off tray section 14 and is evacuated from tray section 14 smooth.

Joint face 39 between plate 34 and lateral wall 36 has a distance in between as short as on the order of nanometer, so that water molecules cannot enter through joint face 39. As a result, joint surface 39 cannot be broken due to swell at freezing.

Figure 8:
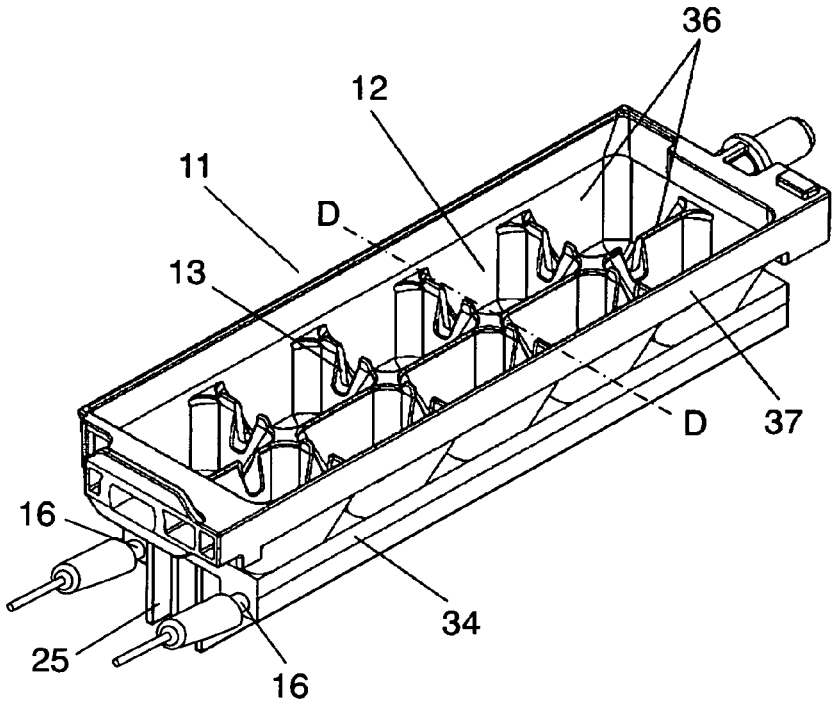
FIG. 8 shows a perspective view of still another ice tray in accordance with the exemplary embodiment of the present invention.
Figure 9:
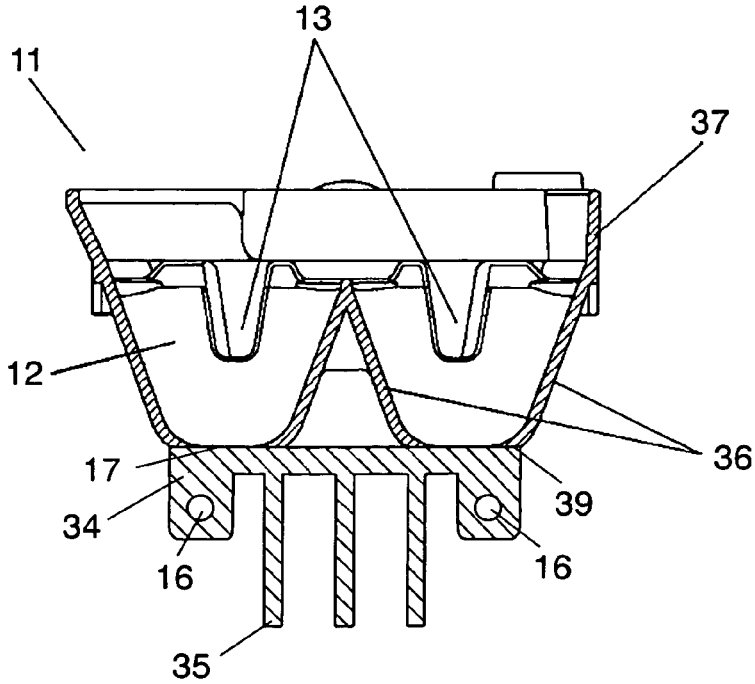
FIG. 9 shows a sectional view of the ice tray taken along line 9—9 shown in FIG. 8.

Next, another structure includes tray section 14 different from that shown in FIG. 6 is demonstrated hereinafter. FIG. 8 shows a perspective view of still another ice tray in accordance with the exemplary embodiment of the present invention. FIG. 9 shows a sectional view of the ice tray taken along line 9—9 shown in FIG. 8.

Tray section 14 includes plural cube-like cells 12 temporarily retaining water, and groove 13 is provided on the lateral wall of cells 12 adjacent to each other so that the water can run back and forth between cells 12. In the construction shown in FIGS. 8 and 9, ten pieces of cells 12 are arranged in 5 rows and 2 columns.

The bottom of each cell 12, namely, underside 17 of tray section 14, is made from metallic plate 34. The material of plate 34, placement of fins 35 and effect of fins 35 remain unchanged from those are discussed previously, so that the descriptions thereof are omitted here. Lateral wall 36, frame 37 and mounting arm 9, i.e. other areas than underside 17 of tray section 14, are made from resin. A type of resin and its effect remain unchanged from those are discussed previously, so the descriptions thereof are omitted here.

Plate 34 and lateral wall 36 are preferably jointed at joint face 39 as close as on the order of nanometer as discussed previously. Such a close joint makes adhesion so strong that no gap through which water can enter is available. As a result, joint surface 39 cannot be broken due to swell at freezing.

Water is poured into given cell 12 of tray 11, then the water runs to adjacent cell 12 via groove 13, so that every cell 12 is filled with the water. In the construction shown in FIG. 8, water of 100 ml is poured into tray 11 so that each cell 12 can receive the water of 10 ml. The water poured into tray 11 dissipates heat from underside 17 (plate 34), lateral wall 36 and the water surface, thereby lowering its temperature gradually. Plate 34, in particular, can accelerate cooling the water due to the effect of fins 35, so that the water freezes into ice quicker than a case where the ice tray entirely made from resin is used. As a result, the ice making is completed in a shorter time.

Tray 11 as discussed above is partially formed of metal excellent in heat conductivity at the sections relevant to cooling the water and is partially formed of resin (polymeric material) excellent in workability at the frame and the arm irrelevant to cooling the water. This structure allows making ice in a shorter time as well as being lower in cost. In FIGS. 6–9, underside 17 is made from metal; however, only the section, which actually retains the water and positively touches at the water and is not influenced by a change in water amount, can be made from metal.

Figure 10:
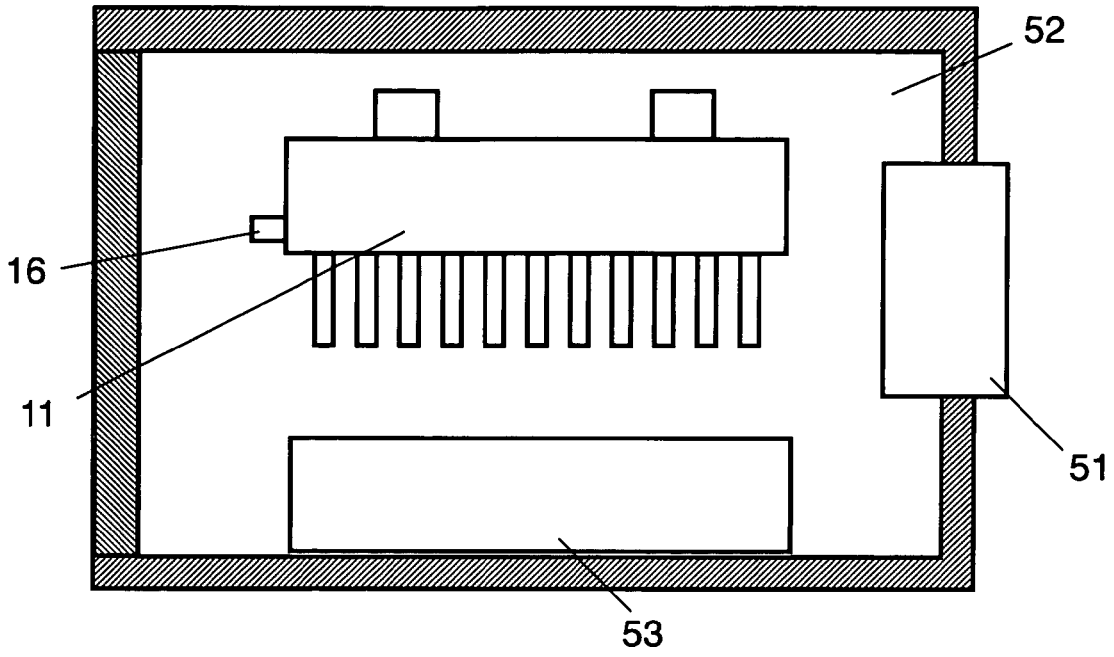
FIG. 10 shows a schematic sectional view illustrating an ice making machine in accordance with the exemplary embodiment of the present invention.
Figure 11:
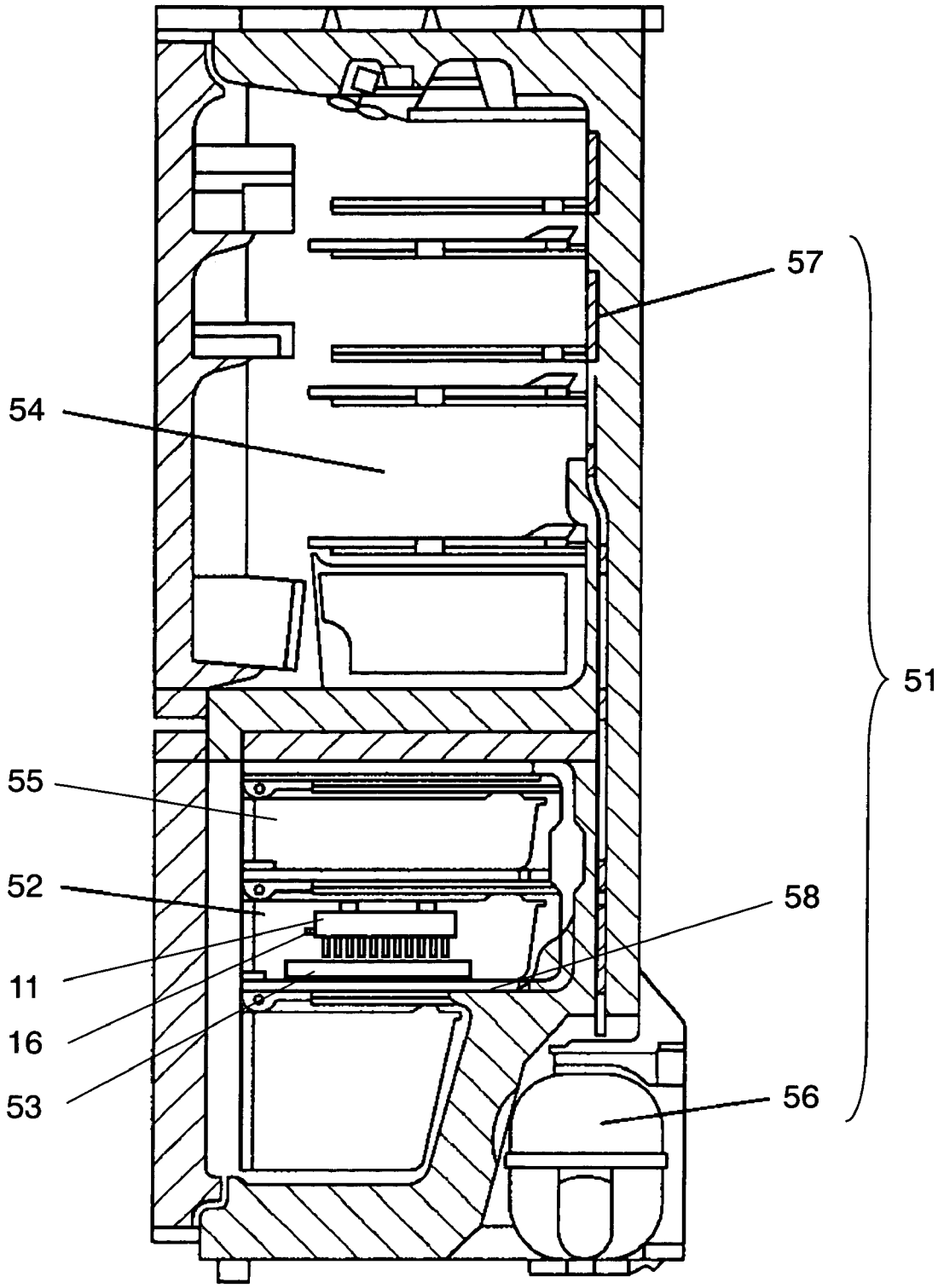
FIG. 11 shows a schematic sectional view illustrating a refrigerator in accordance with the exemplary embodiment of the present invention.
Figure 12:
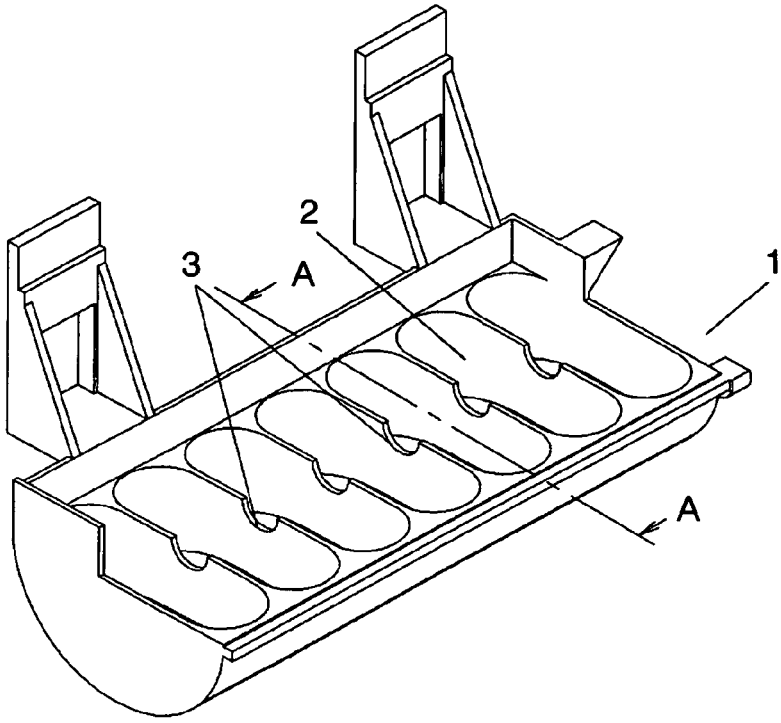
FIG. 12 PRIOR ART
FIG. 12 shows a perspective view of a conventional ice tray.
Figure 13:
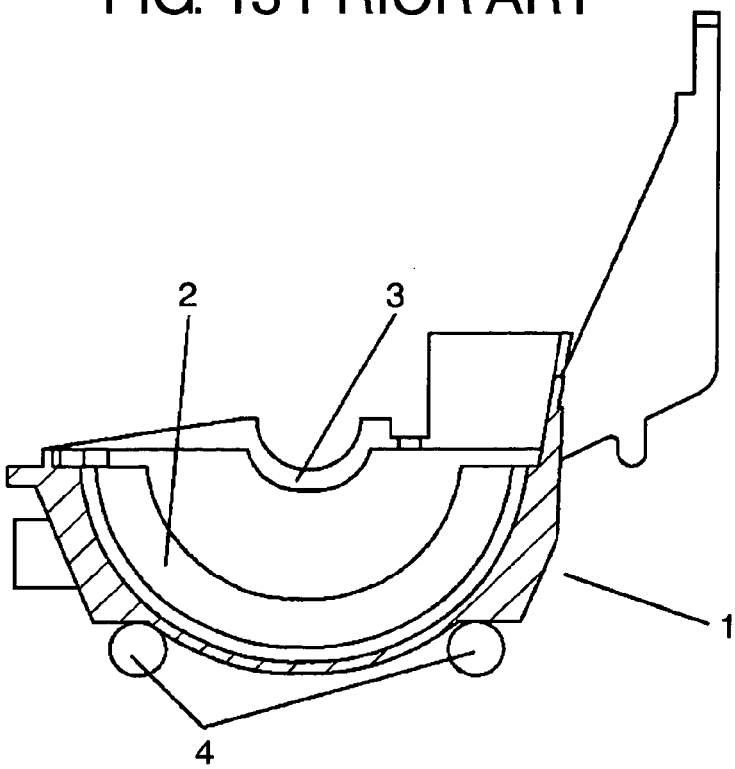
FIG. 13 PRIOR ART
FIG. 13 shows a sectional view of the ice tray taken along line 13—13 shown in FIG. 12.

FIGS. 10 and 11 show sectional views of an ice making machine and a refrigerator both using ice tray 11 discussed above. The ice making machine and the refrigerator have cooling device 51 for cooling water in tray 11; ice-making compartment 52 for accommodating tray 11; and ice dispenser 53 for storing ice come off tray 11 due to the effect of heater 16. The refrigerator further has storage compartment 54 and freezer compartment 55 both of which insides are cooled by cooling device 51. Cooling device 51 includes compressor 56, evaporator 57 for refrigerating and evaporator 58 for freezing and so on. A water feeder (not shown) for supplying water to tray 11 is disposed. The ice making machine and the refrigerator discussed above use tray 11 for ice making, so that ice positively comes off tray 11.

In the embodiment discussed above, cooling device 51 cools water in tray 11 indirectly via an air in ice-making compartment 52. However, cooling device 51 may cool water in tray 11 directly without providing ice-making compartment 52.

Storage compartment 54 and freezer compartment 55 are provided individually in the refrigerator; however, they may be integrated. The refrigerator may have ice-making compartment 52 and freezer compartment 55 without storage compartment 54. Ice-making compartment 52 may be provided in storage compartment 54.

The present invention is not limited to the embodiment discussed above. Unitary molding of heater 16 and tray section 14 does not limit the advantages of the shape and orientation of fins 15, 25 described in FIGS. 1–5, or the construction of tray 14 shown in FIGS. 6–9. They can produce their own advantages discussed previously without the unitary molding.

The ice tray of the present invention includes a tray section and a heater molded together unitarily. This construction improves adhesion between the tray section and the heater, so that its respective cells are warmed uniformly. As a result, the ice can be evacuated smooth. This ice tray can be used in refrigerators and ice making machines.

What is claimed is:

1. An ice tray comprising:

a tray section including a first face and a second face opposite to the first face, and the tray section retaining water temporarily on the first face for making ice; and a heater molded unitarily with the tray section on the second face, and warming the tray section for the ice to come off the tray section;

a fin projecting at least from the second face; and an axis extending along the heating element;

wherein a face of the fin is perpendicular to the axis.

2. The ice tray of claim 1, wherein the fin is one of plural fins, and the fins are disposed substantially at identical intervals.

3. The ice tray of claim 1, wherein the fin shapes like a plate and is disposed substantially in parallel with a flow of cool air.

4. The ice tray of claim 1, wherein the fin shapes like a comb having projections.

5. The ice tray of claim 4, wherein each of the projections shape like one of a needle or a spire.

6. The ice tray of claim 1, wherein the fin is unitarily molded with the tray section.

7. The ice tray of claim 1, wherein the tray section includes a metallic section.

8. The ice tray of claim 7, wherein the metallic section is made from aluminum-based material.

9. The ice tray of claim 7, wherein the tray section further includes polymeric material.

10. The ice tray of claim 9, wherein the tray section includes a joint face where the metallic section is jointed to the polymeric material as close as on an order of nanometer.

11. The ice tray of claim 7, wherein the metallic section is disposed at least on the second face.

12. The ice tray of claim 7, wherein a fin is provided outside the metallic section.

13. An ice tray according to claim 1, wherein said ice tray is included in an ice making machine which involves a cooling device for cooling water in the ice tray.

14. An ice tray according to claim 1, wherein said ice tray is included in a refrigerator which includes:

an ice-making compartment for accommodating the ice tray;

at least one of a refrigerating compartment and a freezing compartment; and a cooling device for cooling water in the ice tray, and at least one of an inside of the refrigerating compartment and an inside of the freezing compartment.

15. An ice tray comprising:

a tray section including a first face and a second face opposite to the first face, and the tray section retaining water temporarily on the first face for making ice; and a heater molded unitarily with the tray section on the second face, and warming the tray section for the ice to come off the tray section;

a fin projecting at least from the second face;

wherein the fin has a louver plate facing a flow of cool air and leaving an opening.

16. An ice tray comprising:

a tray section including a first face and a second face opposite to the first face, and the tray section retaining water temporarily on the first face for making ice; and a heater molded unitarily with the tray section on the second face, and warming the tray section for the ice to come off the tray section;

a fin projecting at least from the second face;

wherein the fin shapes like a plate having a slit.

17. An ice tray comprising:

a tray section including a first face and a second face opposite to the first face, and the tray section retaining water temporarily on the first face for making ice; and a heater molded unitarily with the tray section on the second face, and warming the tray section for the ice to come off the tray section;

wherein the heater includes a letter-U section projecting from the tray section, and a notch is provided to the letter-U section.

18. The ice tray of claim 17, wherein the notch is disposed substantially at a center of the letter-U section.

* * * * *